US009897082B2

(12) United States Patent
Worden et al.

(10) Patent No.: US 9,897,082 B2
(45) Date of Patent: Feb. 20, 2018

(54) AIR COMPRESSOR PROGNOSTIC SYSTEM

(71) Applicant: GENERAL ELECTRIC COMPANY, Schenectady, NY (US)

(72) Inventors: Bret Dwayne Worden, Erie, PA (US); Richard C. Peoples, Grove City, PA (US); Milan Karunaratne, Lawrence Park, PA (US); Jason M. Strode, Lawrence Park, PA (US); Jayaprakash Shreeshailappa Sabarad, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1087 days.

(21) Appl. No.: 13/956,426

(22) Filed: Aug. 1, 2013

(65) Prior Publication Data

US 2013/0336810 A1 Dec. 19, 2013

Related U.S. Application Data

(63) Continuation-in-part of application No. 13/233,856, filed on Sep. 15, 2011, now Pat. No. 8,984,930, and (Continued)

(51) Int. Cl.
*F04B 49/00* (2006.01)
*F04B 27/24* (2006.01)
(Continued)

(52) U.S. Cl.
CPC ..... *F04B 49/00* (2013.01); *F04B 27/24* (2013.01); *F04B 49/065* (2013.01); *F04B 51/00* (2013.01)

(58) Field of Classification Search
CPC ..... F04B 49/00; F04B 49/065; F04B 2201/1201; F04B 2207/70; F04B 51/00; F04B 27/24
See application file for complete search history.

(56) References Cited

U.S. PATENT DOCUMENTS 2,738,659 A 3/1956 Heed
3,216,648 A 11/1965 Ford
(Continued)

FOREIGN PATENT DOCUMENTS

CN 1227918 A 9/1999
CN 2351587 Y 12/1999
(Continued)

OTHER PUBLICATIONS

PCT Search Report and Written opinion of Application No. PCT/US2012/053520 dated Dec. 17, 2012.
(Continued)

*Primary Examiner* — Charles Freay
*Assistant Examiner* — Christopher Bobish
(74) *Attorney, Agent, or Firm* — GE Global Patent Operation; John A. Kramer

(57) ABSTRACT

Systems and methods of the invention relate to monitoring a change in a rotational speed of a crankshaft to identify a failure related to a crankcase breather valve. A reciprocating compressor can include a detection component that is configured to track a rotational speed of a crankshaft of a compressor to identify a change in rotational speed. In an embodiment, the rotational speed can be monitored while unloaded and/or below approximately 800 Revolutions Per Minute (RPM). Based on a change in a rotational speed of the crankshaft, a controller can be configured to communicate an alert which corresponds to a failure related to the crankcase breather valve.

19 Claims, 8 Drawing Sheets

Related U.S. Application Data a continuation-in-part of application No. 13/866,471, filed on Apr. 19, 2013.

(60) Provisional application No. 61/636,192, filed on Apr. 20, 2012.

(51) Int. Cl.
*F04B 49/06* (2006.01)
*F04B 51/00* (2006.01)

(56) References Cited

U.S. PATENT DOCUMENTS 3,299,825 A 1/1967 Phiystein
3,592,563 A 7/1971 Glass et al.
3,778,761 A 12/1973 Cribbins
3,855,509 A 12/1974 Wright
4,216,672 A 8/1980 Henry et al.
4,216,915 A 8/1980 Hengartner et al.
4,248,053 A 2/1981 Sisk
4,334,427 A 6/1982 Armstrong
4,364,268 A 12/1982 Zompolas
4,653,986 A 3/1987 Ashton
4,687,982 A 8/1987 Palaniappan
4,689,602 A 8/1987 Morihara et al.
4,793,047 A 12/1988 Curtis et al.
5,000,664 A 3/1991 Lawless et al.
5,106,270 A 4/1992 Goettel et al.
5,112,196 A 5/1992 Schuh
5,437,422 A 8/1995 Newman
5,471,400 A 11/1995 Smalley et al.
5,487,516 A 1/1996 Murata et al.
5,546,015 A 8/1996 Okabe
5,685,507 A 11/1997 Horst et al.
5,711,272 A 1/1998 Maegawa et al.
5,728,941 A 3/1998 Yamamoto et al.
5,738,311 A 4/1998 Fernandez
5,777,547 A 7/1998 Waldrop
5,785,081 A 7/1998 Krawczyk et al.
5,817,934 A 10/1998 Skantar
5,860,800 A 1/1999 Kramer et al.
5,883,489 A 3/1999 Konrad
5,885,060 A 3/1999 Cunkelman et al.
5,897,597 A * 4/1999 O'Daniel ..... G01M 3/025 123/574
5,950,967 A 9/1999 Montgomery
5,986,577 A 11/1999 Bezos
5,986,579 A 11/1999 Halvorson
6,023,651 A 2/2000 Nakayama et al.
6,027,311 A 2/2000 Hill et al.
6,036,456 A 3/2000 Peters et al.
6,045,197 A 4/2000 McGaugh
6,062,825 A 5/2000 Chovan
6,081,769 A 6/2000 Curtis
6,132,012 A 10/2000 Ishii
6,132,177 A 10/2000 Loprete et al.
6,203,285 B1 3/2001 Wagner et al.
6,305,313 B1 10/2001 Cunkelman et al.
6,341,497 B2 1/2002 Herrick et al.
6,390,779 B1 5/2002 Cunkelman
6,456,937 B1 9/2002 Doner et al.
6,490,523 B2 12/2002 Doner
6,510,731 B2 1/2003 Schricker et al.
6,616,416 B1 9/2003 Tolbert, Jr.
6,651,034 B1 11/2003 Hedlund et al.
6,658,346 B2 12/2003 Maegawa
6,679,689 B2 1/2004 Takahashi et al.
6,680,918 B1 1/2004 Haley
6,691,957 B2 2/2004 Hess, Jr. et al.
6,758,147 B2 7/2004 Howard et al.
6,759,951 B2 7/2004 Kellner et al.
6,837,550 B2 1/2005 Dougherty et al.
6,862,502 B2 3/2005 Peltz et al.
6,922,619 B2 7/2005 Baig et al.
6,937,925 B2 8/2005 Smith
6,968,268 B2 11/2005 Yamada et al.
6,972,670 B2 12/2005 Laduc et al.
6,997,418 B1 2/2006 Sanzone
7,008,472 B2 3/2006 Fornof et al.
7,021,588 B2 4/2006 Hess, Jr. et al.
7,031,850 B2 4/2006 Kambli et al.
7,073,753 B2 7/2006 Root et al.
7,111,592 B1 9/2006 Kern et al.
7,133,766 B2 11/2006 Kokubo
7,153,106 B2 12/2006 Cornwell
7,177,732 B2 2/2007 Kraeling et al.
7,197,916 B2 4/2007 Matsumoto et al.
7,216,552 B2 5/2007 Fogelstrom
7,222,003 B2 5/2007 Stull et al.
7,302,895 B2 12/2007 Kumar et al.
7,309,929 B2 12/2007 Donnelly et al.
7,388,483 B2 6/2008 Welles et al.
7,395,141 B1 7/2008 Seck et al.
7,428,453 B2 9/2008 Davenport et al.
7,447,571 B2 11/2008 Nickles et al.
7,509,233 B2 * 3/2009 Pervaiz ..... F04B 49/065 417/231
7,522,990 B2 4/2009 Daum et al.
7,618,011 B2 11/2009 Oleski et al.
7,620,522 B2 11/2009 Bredau et al.
7,650,207 B2 1/2010 Metzger
7,715,956 B2 5/2010 Bryant
7,761,223 B2 7/2010 Wang et al.
7,983,805 B2 7/2011 Bryant
8,073,582 B2 12/2011 Kellner et al.
8,147,211 B2 4/2012 Grant et al.
8,190,314 B2 5/2012 Smith et al.
8,522,690 B2 9/2013 Smith et al.
8,696,335 B2 4/2014 Fujimoto et al.
8,961,147 B2 2/2015 Van Campfort et al.
9,109,517 B2 8/2015 Banerjee et al.
2002/0050271 A1 5/2002 Hasegawa et al.
2002/0051710 A1 5/2002 Yoo et al.
2002/0072833 A1 6/2002 Gray
2002/0159896 A1 10/2002 Finnamore et al.
2003/0077179 A1 4/2003 Collins et al.
2004/0079226 A1 4/2004 Barrett
2004/0120825 A1 6/2004 Bouton et al.
2004/0148926 A1 8/2004 Morinaga et al.
2004/0167738 A1 8/2004 Miller
2004/0193384 A1 9/2004 Edlund et al.
2004/0267450 A1 12/2004 Kernwein
2005/0204805 A1 9/2005 Wakahara et al.
2006/0033611 A1 2/2006 Froitzheim
2006/0222515 A1 10/2006 Delmotte et al.
2006/0224309 A1 10/2006 Schmidt et al.
2007/0000308 A1 1/2007 Weissgerber
2007/0068181 A1 3/2007 Kim
2007/0253838 A1 11/2007 Leiss
2008/0022702 A1 1/2008 Fijas et al.
2008/0257532 A1 10/2008 Fijas et al.
2009/0076669 A1 3/2009 Krishnaswamy et al.
2009/0120174 A1 5/2009 Nodera et al.
2009/0229355 A1 9/2009 Shoda
2009/0248226 A1 10/2009 Kellner et al.
2010/0049384 A1 2/2010 Kraeling et al.
2010/0106458 A1 4/2010 Leu et al.
2010/0130124 A1 5/2010 Teeter et al.
2010/0147270 A1 6/2010 Pursifull et al.
2010/0153027 A1 6/2010 Bredau et al.
2010/0162797 A1 7/2010 Summers et al.
2010/0211296 A1 8/2010 Saunders
2010/0235017 A1 9/2010 Peltonen et al.
2010/0281843 A1 11/2010 Smith
2010/0303658 A1 12/2010 Ito et al.
2011/0046902 A1 2/2011 Kyllingstad
2011/0213538 A1 9/2011 Amann et al.
2011/0320071 A1 12/2011 Karg
2012/0243375 A1 9/2012 Melvin, II et al.
2012/0316707 A1 12/2012 Kraeling et al.
2012/0316708 A1 12/2012 Kraeling et al.
2012/0317282 A1 12/2012 Kraeling et al.
2012/0321486 A1 12/2012 Scarpinato et al.
2013/0168503 A1 7/2013 Cooper et al.

(56) References Cited

U.S. PATENT DOCUMENTS

| | | | |
|---|---|---|---|
| 2014/0136031 | A1 | 5/2014 | Burnett et al. |
| 2014/0188306 | A1 | 7/2014 | Kumar et al. |
| 2014/0372498 | A1 | 12/2014 | Mian et al. |

FOREIGN PATENT DOCUMENTS

| | | | |
|---|---|---|---|
| CN | 1880936 | A | 12/2006 |
| CN | 201358901 | Y | 12/2009 |
| CN | 101654113 | A | 2/2010 |
| CN | 201439746 | U | 4/2010 |
| CN | 102292253 | A | 12/2011 |
| CN | 102348589 | A | 2/2012 |
| DE | 10052664 | A1 | 5/2002 |
| DE | 102007039793 | A1 | 2/2009 |
| EP | 0522849 | A1 | 1/1993 |
| EP | 1253059 | A1 | 10/2002 |
| EP | 1508736 | A1 | 2/2005 |
| EP | 1 947 341 | A1 | 7/2008 |
| EP | 2236863 | B1 | 11/2012 |
| GB | 658118 | A | 10/1951 |
| JP | 2003021072 | A | 1/2003 |
| KR | 100779192 | B1 | 11/2007 |
| RU | 32457 | U1 | 9/2003 |
| RU | 2238860 | C1 | 10/2004 |
| RU | 2519793 | C1 | 6/2014 |
| SU | 498189 | A1 | 1/1976 |
| WO | 2006056214 | A1 | 6/2006 |
| WO | 2008033677 | A2 | 3/2008 |
| WO | 2014004003 | A2 | 1/2014 |

OTHER PUBLICATIONS

Bearing Failure Detection on an Air Compressor Case History "downloaded from http://www.termogram.com/articulos/doc_download/3-case-study-azimadli-compresor-de-aire," date of publication uncertain, but possibly published no later than Jan. 12, 2010.

U.S. Appl. No. 13/857,334, filed Apr. 5, 2013, Bret Dwayne Worden et al.

U.S. Appl. No. 13/866,435, filed Apr. 19, 2013, Bret Dwayne Worden et al.

U.S. Appl. No. 13/233,856, filed Sep. 15, 2011, Bret Dwayne Worden et al.

James et al., Acoustical Oceanography and Underwater Acoustics: Acoustical Measurement of Coastal Ocean Processes I, Acoustical Society of America, vol. No. 101, Issue No. 5, pp. 3015-3048, May 1997.

PCT Search Report and Written Opinion issued in connection with related PCT Application No. PCT/US2013/036527 dated Aug. 25, 2014.

U.S. Non-Final Office Action issued in connection with related U.S. Appl. No. 13/857,334 dated Apr. 10, 2015.

Unofficial English Translation of Chinese Office Action issued in connection with related CN Application No. 201280044852.X dated Apr. 22, 2015.

U.S. Non-Final Office Action issued in connection with related U.S. Appl. No. 13/866,573 dated May 7, 2015.

U.S. Non-Final Office Action issued in connection with related U.S. Appl. No. 13/866,670 dated May 22, 2015.

U.S. Final Office Action issued in connection with related U.S. Appl. No. 13/866,435 dated Oct. 30, 2015.

U.S. Final Office Action issued in connection with related U.S. Appl. No. 13/866,670 dated Dec. 17, 2015.

U.S. Final Office Action issued in connection with related U.S. Appl. No. 13/866,573 dated Dec. 31, 2015.

U.S. Final Office Action issued in connection with related U.S. Appl. No. 13/857,334 dated Jan. 14, 2016.

Unofficial English Translation of Chinese Office Action issued in connection with related CN Application No. 201380032394.2 dated Feb. 2, 2016.

U.S. Non-Final Office Action issued in connection with related U.S. Appl. No. 13/866,435 dated Mar. 26, 2015.

Australian Office Action issued in connection with related AU Application No. 2013248977 dated Apr. 20, 2016.

U.S. Non-Final Office Action issued in connection with related U.S. Appl. No. 13/866,435 dated Apr. 22, 2016.

U.S. Non-Final Office Action issued in connection with related U.S. Appl. No. 13/866,573 dated Jun. 3, 2016.

U.S. Non-Final Office Action issued in connection with related U.S. Appl. No. 13/866,499 dated Jul. 14, 2016.

U.S. Final Rejection issued in connection with related U.S. Appl. No. 13/866,435 dated Nov. 3, 2016.

U.S. Non-Final Rejection issued in connection with related U.S. Appl. No. 13/866,573 dated Dec. 15, 2016.

PCT Search Report and Written Opinion issued in connection with related PCT Application No. PCT/US2007/066011 dated Oct. 2, 2007.

PCT International Preliminary Report on Patentability issued in connection with related PCT Application No. PCT/US2007/066011 dated Oct. 30, 2008.

U.S. Non-Final Office Action issued in connection with related U.S. Appl. No. 11/552,602 dated Mar. 26, 2010.

Unofficial English Translation of Chinese Office Action issued in connection with related CN Application No. 200780013958.2 dated Jul. 19, 2010.

U.S. Final Office Action issued in connection with related U.S. Appl. No. 11/552,602 dated Oct. 27, 2010.

Russian Office Action issued in connection with related RU Application No. 2008145039 dated Feb. 1, 2011.

U.S. Non-Final Office Action issued in connection with related U.S. Appl. No. 11/552,602 dated Jun. 7, 2011.

Mexican Office Action issued in connection with related MX Application No. MX/a/2008/013043 dated Jun. 16, 2011.

Unofficial English Translation of Chinese Office Action issued in connection with related CN Application No. 200780013958.2 dated Jul. 6, 2011.

Russian Office Action issued in connection with related RU Application No. 2008145039 dated Sep. 21, 2011.

U.S. Non-Final Office Action issued in connection with related U.S. Appl. No. 11/552,602 dated Nov. 16, 2011.

Russian Decision on Grant issued in connection with related RU Application No. 2008145039 dated Apr. 13, 2012.

U.S. Notice of Allowance issued in connection with related U.S. Appl. No. 11/552,602 dated May 30, 2012.

Australian Examination Report issued in connection with related AU Application No. 2007238317 dated Dec. 7, 2012.

Canadian Office Action issued in connection with related CA Application No. 2648296 dated Feb. 25, 2013.

Australian Notice of Acceptance issued in connection with related AU Application No. 2007238317 dated Mar. 8, 2013.

U.S. Non-Final Office Action issued in connection with related U.S. Appl. No. 13/741,649 dated Oct. 20, 2014.

U.S. Notice of Allowance issued in connection with related U.S. Appl. No. 13/741,649 dated Apr. 24, 2015.

Chinese Office Action issued in connection with related CN Application No. 201310373253.9 dated Feb. 14, 2016.

Eurasian Search Report issued in connection with related EA Application No. 201591470 dated Mar. 9, 2016.

U.S. Non-Final Office Action issued in connection with related U.S. Appl. No. 14/741,229 dated Mar. 18, 2016.

U.S. Non-Final Office Action issued in connection with related U.S. Appl. No. 14/803,089 dated Apr. 8, 2016.

U.S. Non-Final Office Action issued in connection with related U.S. Appl. No. 14/520,585 dated Apr. 13, 2016.

Australian Examination Report issued in connection with related AU Application No. 2015218565 dated May 16, 2016.

Australian Examination Report issued in connection with related AU Application No. 2015243113 dated Jun. 28, 2016.

U.S. Final Office Action issued in connection with related U.S. Appl. No. 14/741,229 dated Aug. 18, 2016.

U.S. Final Office Action issued in connection with related U.S. Appl. No. 14/803,089 dated Oct. 21, 2016.

(56) References Cited

OTHER PUBLICATIONS

U.S. Notice of Allowance issued in connection with related U.S. Appl. No. 14/836,063 dated Feb. 7, 2017.
Australian Examination Report issued in connection with related AU Application No. 2013211559 dated Feb. 10, 2017.
Australian Notice of Acceptance issued in connection with related AU Application No. 2015243113 dated Apr. 18, 2017.
International Search Report and Written Opinion issued in connection with related PCT Application No. PCT/US2013/037567 dated Aug. 25, 2014.
International Preliminary Report on Patentability issued in connection with related PCT Application No. PCT/US2013/037567 dated Oct. 21, 2014.
Notice of Allowance towards related U.S. Appl. No. 13/233,856 dated Nov. 21, 2014.
Non Final Rejection towards related U.S. Appl. No. 13/866,471 dated Mar. 24, 2016.
Non-Final Rejection towards related U.S. Appl. No. 13/866,471 dated Sep. 23, 2016.
Final Rejection towards related U.S. Appl. No. 13/866,573 dated Jun. 29, 2017.
Burkell et al., U.S. Appl. No. 61/636,192, dated Apr. 20, 2012.
Worden et al., U.S. Appl. No. 13/866,573, dated Apr. 19, 2013.
Worden et al., U.S. Appl. No. 13/866,670, dated Apr. 19, 2013.
Worden et al., U.S. Appl. No. 13/866,499, dated Apr. 19, 2013.
Worden et al., U.S. Appl. No. 13/866,471, dated Apr. 19, 2013.
Foy et al., U.S. Appl. No. 60/792,428, dated Apr. 17, 2006.
Foy et al., U.S. Appl. No. 11/552,602, dated Oct. 25, 2006.
Cooper et al., U.S. Appl. No. 13/593,258, dated Aug. 23, 2012.
Cooper et al., U.S. Appl. No. 14/275,297, dated May 12, 2014.
Cooper et al., U.S. Appl. No. 14/836,063, dated Aug. 26, 2015.
Kraeling et al., U.S. Appl. No. 13/741,649, dated Jan. 15, 2013.
Kraeling et al., U.S. Appl. No. 14/803,089, dated Jan. 15, 2013.
Smith et al., U.S. Appl. No. 14/520,585, dated Oct. 22, 2014.
Smith et al., U.S. Appl. No. 15/421,978, dated Feb. 1, 2017.
Kellner et al., U.S. Appl. No. 62/049,524, dated Sep. 12, 2014.
Kellner et al., U.S. Appl. No. 14/741,229, dated Jun. 16, 2015.

* cited by examiner

AIR COMPRESSOR PROGNOSTIC SYSTEM

CROSS-REFERENCE TO RELATED APPLICATIONS

This application is a continuation-in-part of U.S. application Ser. No. 13/233,856, filed Sep. 15, 2011, entitled "SYSTEM AND METHOD FOR DIAGNOSING A RECIPROCATING COMPRESSOR," and of U.S. application Ser. No. 13/866,471, filed Apr. 19, 2013, entitled "SYSTEM AND METHOD FOR A COMPRESSOR," which claims the benefit of U.S. Provisional Application Ser. No. 61/636,192, filed Apr. 20, 2012. The entireties of the aforementioned applications are incorporated herein by reference.

BACKGROUND

Technical Field

Embodiments of the subject matter disclosed herein relate to detecting a failure related to a compressor.

Discussion of Art

Compressors compress gas, such as air. An air compressor can include three cylinders with two stages that are air cooled and driven by an electric motor utilized in locomotive applications. The compressor can have two low pressure cylinders which deliver an intermediate pressure air supply to a single high pressure cylinder for further compression for final delivery to an air reservoir. Compressor or compressor components can include various failures which increase difficulties in starting a compressor or reduce its flow or pressure capability.

It may be desirable to have a system and method that differ from those systems and methods that are currently available.

BRIEF DESCRIPTION

In an embodiment, a method is provided that includes at least the following steps: maintaining a vacuum within the crankcase of the compressor utilizing a crankcase breather valve; detecting a change in a resistance to piston motion relating to the crankcase breather valve; and initiating a signal related to a function of the crankcase breather valve based upon the detected change in the resistance to piston motion.

In an embodiment, a method is provided that includes at least the following steps: controlling a crankcase breather valve for air to flow out of a crankcase of the compressor during suction strokes of at least one piston of the compressor; controlling the crankcase breather valve to maintain vacuum within the crankcase during compression strokes of the at least one piston of the compressor; with a controller, receiving a first signal indicative of a detected rotational speed of a crankshaft of the compressor during the compression strokes, the crankshaft disposed in the crankcase; with the controller, identifying a change in the rotational speed; and with the controller, generating a second signal related to a function of the crankcase breather valve based upon the change in the rotational speed that is identified.

In an embodiment, a system is provided that includes a compressor operable to provide compressed air, and comprising a crankcase breather valve, a crankshaft, and a crankcase, wherein the crankshaft is disposed in the crankcase and is coupled to the crankcase breather valve, a detector that is configured to detect a rotational speed of the crankshaft; and a controller that is in communication with the detector and configured to determine a change in resistance relating to the crankcase breather valve based at least in part on the detected rotational speed of the crankshaft.

In an embodiment, a system is provided that includes sensing means for sensing a rotational speed of a compressor crankshaft during compression strokes of the compressor; the compressor comprising a crankcase, the crankshaft disposed in the crankcase, and a crankcase breather valve configured to release air from the crankcase during suction strokes of the compressor and maintain an at least partial vacuum in the crankcase during the compression strokes; and signal generation means for generating a signal relating to an operational status of the crankcase breather valve responsive to a change in the rotational speed meeting one or more designated criteria.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
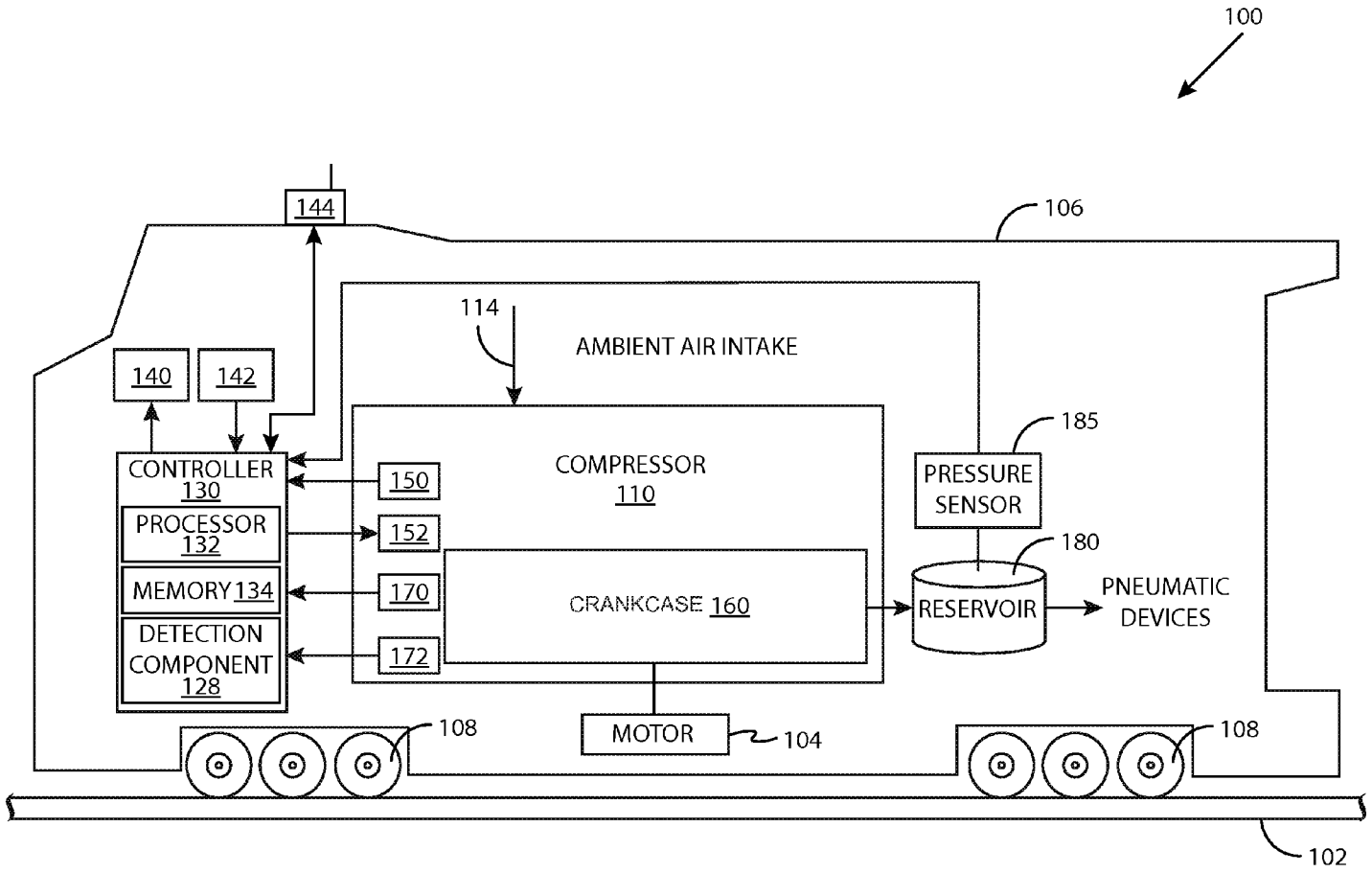
FIG. 1 is an illustration of an embodiment of a vehicle system with a compressor.

Embodiments of the subject matter disclosed herein relate to systems and methods that monitor a change in a rotational speed of a crankshaft of a reciprocating compressor to identify a failure related to a crankcase breather valve of the compressor. The reciprocating compressor can include a detection component that is configured to track the rotational speed of the crankshaft to identify a change in rotational speed. In an embodiment, the rotational speed can be monitored while unloaded and/or operating at low speed such as at or below approximately 800 Revolutions Per Minute (RPM). Based on a change in the rotational speed of the crankshaft, a controller can be configured to communicate an alert which corresponds to a failure related to the crankcase breather valve. In an embodiment, based upon an amount of change detected, an urgency of the alert can be increased (e.g., increased intensity, required maintenance, shutdown until maintenance, among others).

With reference to the drawings, like reference numerals designate identical or corresponding parts throughout the several views. However, the inclusion of like elements in different views does not mean a given embodiment necessarily includes such elements or that all embodiments of the invention include such elements.

The term "component" as used herein can be defined as a portion of hardware, a portion of software, or a combination thereof. A portion of hardware can include at least a processor and a portion of memory, wherein the memory includes an instruction to execute. The term "vehicle" as used herein can be defined as an asset that is a mobile machine or a moveable transportation asset that transports at least one of a person, people, or a cargo. For instance, a vehicle can be, but is not limited to being, a rail car, an intermodal container, a locomotive, a marine vessel, mining equipment, industrial equipment, construction equipment, and the like. The term "loaded" as used herein can be defined as a compressor system mode where air is being compressed into the reservoir. The term "unloaded" as used herein can be defined as a compressor system mode where air is not being compressed into the reservoir.

A compressor compresses gas, such as air. In some embodiments, the compressed gas is supplied to operate pneumatic or other equipment powered by compressed gas. A compressor may be used for mobile applications, such as vehicles. By way of example, vehicles utilizing compressors include locomotives, on-highway vehicles, off-highway vehicles, mining equipment, and marine vessels. In other embodiments, a compressor may be used for stationary applications, such as in manufacturing or industrial applications requiring compressed air for pneumatic equipment among other uses. The compressor depicted in the below figures is one which utilizes spring return inlet and discharge valves for each cylinder, wherein the movement of these valves is caused by the differential pressure across each cylinder as opposed to a mechanical coupling to the compressor crank shaft. The subject invention can be applicable to machines with either type of valve (e.g., spring return valves, mechanical coupled valves, among others) and the spring return valve is depicted solely for example and not to be limiting on the subject innovation.

Figure 2:
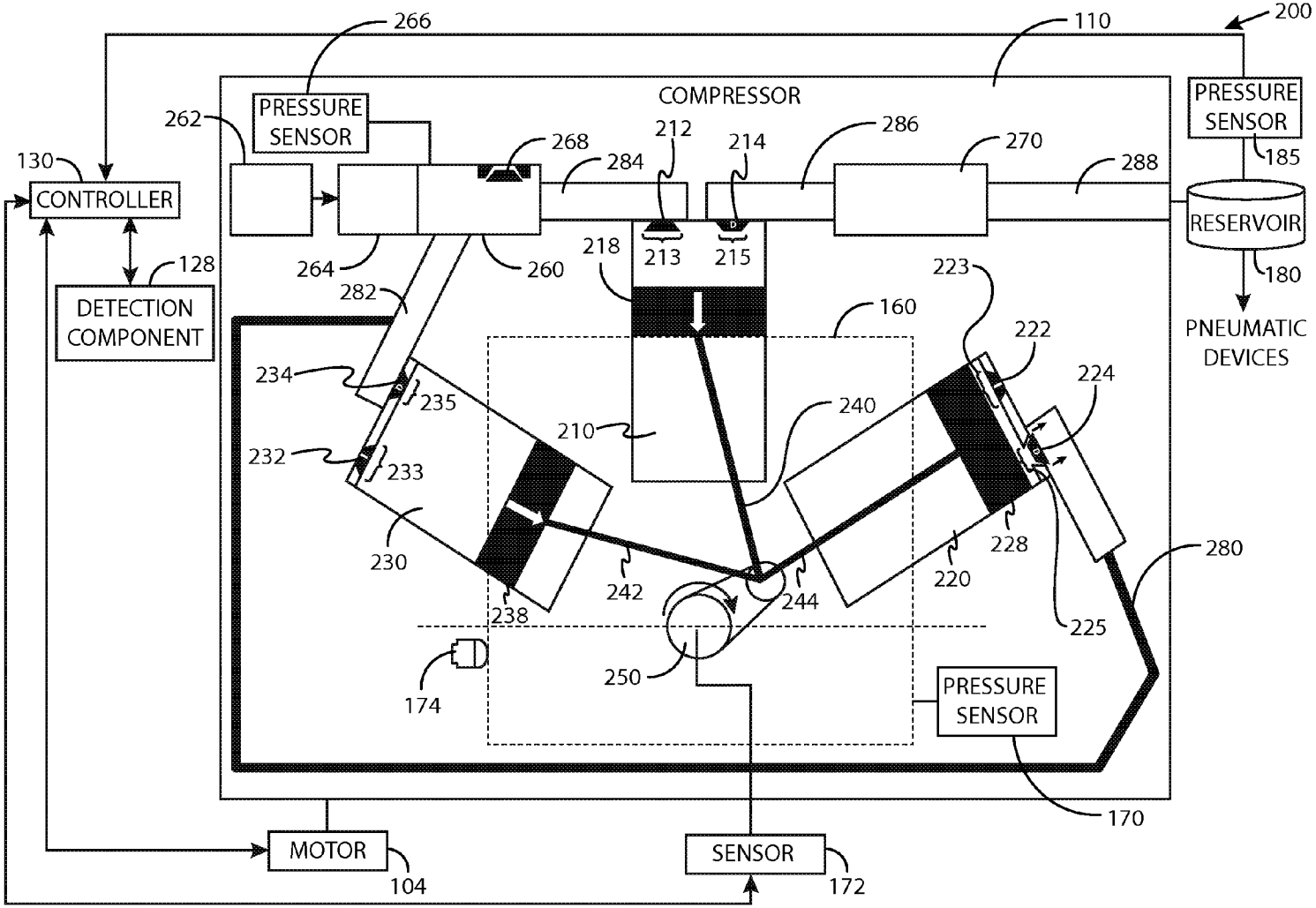
FIG. 2 is an illustration of an embodiment of system that includes a compressor.

FIG. 1 illustrates a block diagram of an embodiment of a vehicle system 100. The vehicle system 100 is depicted as a rail vehicle 106 (e.g., a locomotive) configured to run on a rail 102 via a plurality of wheels 108. The vehicle system includes a compressor system with a compressor 110. In an embodiment, the compressor is a reciprocating compressor that delivers air at high pressure. In another embodiment, the compressor is a reciprocating compressor with a bi-directional drive system that drives a piston in a forward direction and the reverse direction. In an embodiment, the compressor receives air from an ambient air intake 114. The air is then compressed to a pressure greater than the ambient pressure and the compressed air is stored in reservoir 180, which is monitored by a reservoir pressure sensor 185. In one embodiment, the compressor is a two-stage compressor (such as illustrated in FIG. 2) in which ambient air is compressed in a first stage to a first pressure level and delivered to a second stage, which further compresses the air to a second pressure level that is higher than the first pressure level. The compressed air at the second pressure level is stored in a reservoir. The compressed air may then be provided to one or more pneumatic devices as needed. In other embodiments, the compressor 110 may be a single stage or multi-stage compressor.

The compressor includes a crankcase 160. The crankcase is an enclosure for a crankshaft (not shown in FIG. 1) connected to cylinders (not shown in FIG. 1) of the compressor. A motor 104 is employed to rotate the crankshaft to drive the pistons within the cylinders. In embodiments, the motor 104 may be an electric or non-electric motor. In another embodiment, the crankshaft may be coupled to a drive shaft of an engine or other power source configured to rotate the crankshaft of the compressor. In each embodiment, the crankshaft may be lubricated with compressor oil that is pumped by an oil pump (not shown) and sprayed onto the crankshaft. The crankshaft is mechanically coupled to a plurality of pistons via respective connecting rods. The pistons are drawn and pushed within their respective cylinders as the crankshaft is rotated to compress a gas in one or more stages.

The vehicle system further includes a controller 130 for controlling various components related to the vehicle system. In an embodiment, the controller is a computerized control system with a processor 132 and a memory 134. The memory may be computer readable storage media, and may include volatile and/or non-volatile memory storage. In an embodiment, the controller includes multiple control units and the control system may be distributed among each of the control units. In yet another embodiment, a plurality of controllers may cooperate as a single controller interfacing with multiple compressors distributed across a plurality of vehicles. Among other features, the controller may include instructions for enabling on-board monitoring and control of vehicle operation. Stationary applications may also include a controller for managing the operation of one or more compressors and related equipment or machinery.

In an embodiment, the controller receives signals from one or more sensors 150 to monitor operating parameters and operating conditions, and correspondingly adjust actuators 152 to control operation of the vehicle system and the compressor. In various embodiments, the controller receives signals from one or more sensors corresponding to compressor speed, compressor load, boost pressure, exhaust pressure, ambient pressure, exhaust temperature, or other parameters relating to the operation of the compressor or surrounding system. In another embodiment, the controller receives a signal from a crankcase pressure sensor 170 that corresponds to the pressure within the crankcase. In yet another embodiment, the controller receives a signal from a crankshaft position sensor 172 that indicates a position of the crankshaft. The position of the crankshaft may be identified by the angular displacement of the crankshaft relative to a known location such that the controller is able to determine the position of each piston within its respective cylinder based upon the position of the crankshaft. In some embodiments, the controller controls the vehicle system by sending commands or power to various components. On a locomotive, for example, such components may include traction motors, alternators, cylinder valves, and throttle controls among others. The controller may be connected to the sensors and actuators through wires that may be bundled together into one or more wiring harnesses to reduce space in vehicle system devoted to wiring and to protect the signal wires from abrasion and vibration. In other embodiments, the controller communicates over a wired or wireless network that may allow for the addition of components without dedicated wiring.

The controller may include onboard electronic diagnostics for recording operational characteristics of the compressor. Operational characteristics may include measurements from sensors associated with the compressor or other components of the system. Such operational characteristics may be stored in a database in memory. In one embodiment, current operational characteristics may be compared to past operational characteristics to determine trends of compressor performance.

The controller may include onboard electronic diagnostics for identifying and recording potential degradation and failures of components of vehicle system. For example, when a potentially degraded component is identified, a diagnostic code may be stored in memory. In one embodiment, a unique diagnostic code may correspond to each type of degradation that may be identified by the controller. For example, a first diagnostic code may indicate a malfunctioning exhaust valve of a cylinder, a second diagnostic code may indicate a malfunctioning intake valve of a cylinder, a third diagnostic code may indicate deterioration of a piston or cylinder resulting in a blow-by condition, and so on. Additional diagnostic codes may be defined to indicate other deteriorations or failure modes. In yet other embodiments, diagnostic codes may be generated dynamically to provide information about a detected problem that does not correspond to a predetermined diagnostic code. In some embodiments, the controller modifies the output of charged air from the compressor, such as by reducing the duty cycle of the compressor, based on parameters such as the condition or availability of other compressor systems (such as on adjacent locomotive engines), environmental conditions, and overall pneumatic supply demand.

The controller may be further linked to display 140, such as a diagnostic interface display, providing a user interface to the operating crew and/or a maintenance crew. The controller may control the compressor, in response to operator input via user input controls 142, by sending a command to correspondingly adjust various compressor actuators. Non-limiting examples of user input controls may include a throttle control, a braking control, a keyboard, and a power switch. Further, operational characteristics of the compressor, such as diagnostic codes corresponding to degraded components, may be reported via display to the operator and/or the maintenance crew.

The vehicle system may include a communications system 144 linked to the controller. In one embodiment, communications system may include a radio and an antenna for transmitting and receiving voice and data messages. For example, data communications may be between vehicle system and a control center of a railroad, another locomotive, a satellite, and/or a wayside device, such as a railroad switch. For example, the controller may estimate geographic coordinates of a vehicle system using signals from a GPS receiver. As another example, the controller may transmit operational characteristics of the compressor to the control center via a message transmitted from communications system. In one embodiment, a message may be transmitted to the command center by communications system when a degraded component of the compressor is detected and the vehicle system may be scheduled for maintenance.

The system can include a detection component 128 that is configured to monitor a rotational speed of a crankshaft of the compressor. The rotational speed of the crankshaft can be detected and compared to one or more signatures (e.g., data related to the rotational speed with conditions that are not related to a failure). In particular, the detection component can be configured to detect a reduction in a rotational speed of the crankshaft during an unloaded condition at or under approximately 800 RPM, wherein the reduction can be based upon a reduction in crankshaft rotation. In an embodiment, the reduction can be based upon lack of oil maintenance, lack of proper cooling, and/or deterioration of ventilation components (e.g., filter, flapper, among others). In particular, the detection component can compare the rotational speed of the crankshaft to a signature such as, but not limited to, a one (1) per revolution pulsation in a speed signature.

Based upon the detection of the rotational speed of the crankshaft, the controller can be configured to communicate an alert related thereto. The alert can be a signal (e.g., audio, text, visual, haptic, among others) that indicates a change in the rotational speed of the crankshaft. In addition, the controller can be configured to drive on-board incidents identifying reduced compressor performance, recommending maintenance (e.g., oil change, strainer change, crankcase breather valve change, High-Pressure (HP) head inspection, HP head change, among others).

Figure 3:
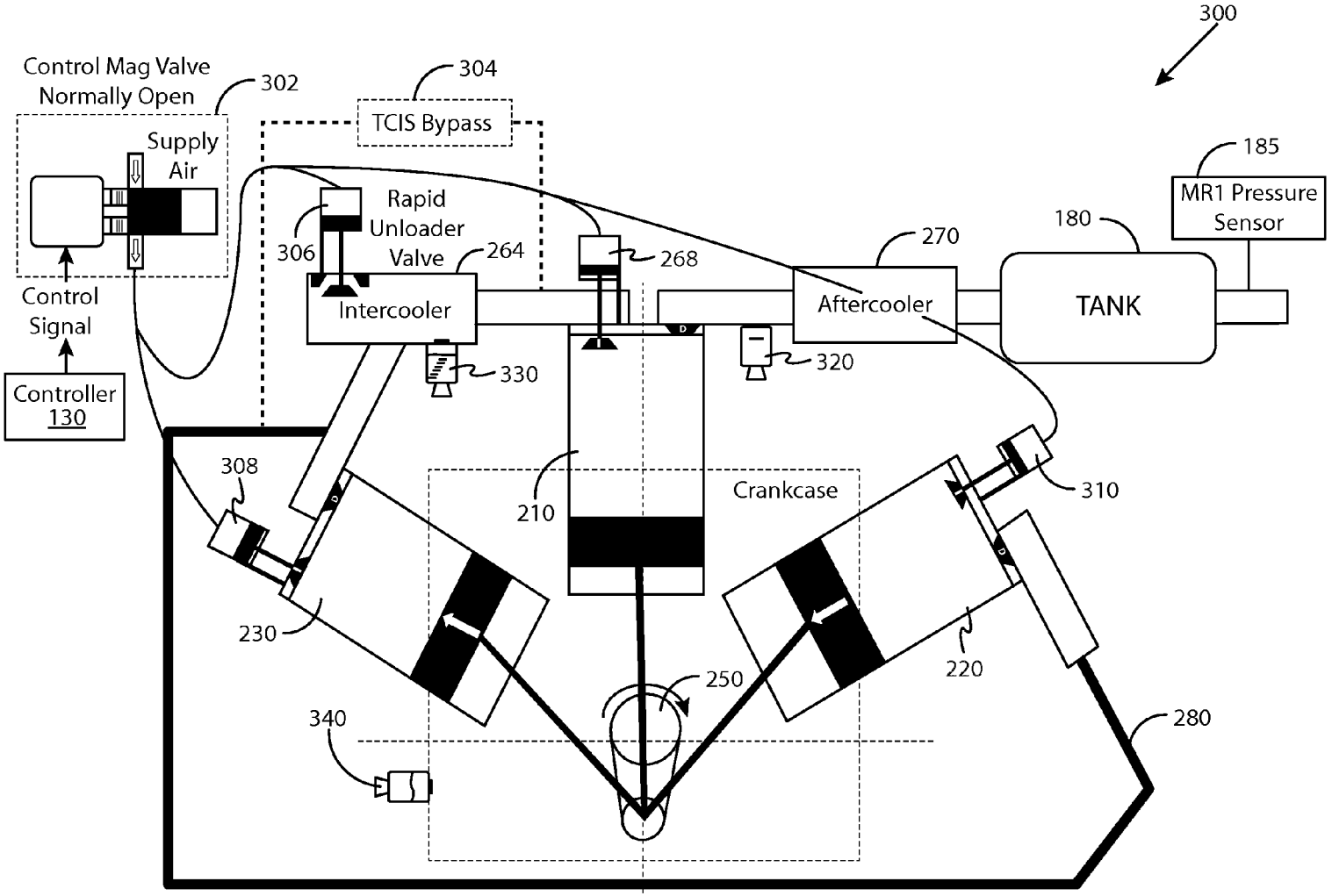
FIG. 3 is an illustration of an embodiment of a system that includes a compressor.

As discussed above, the term "loaded" refers a compressor mode where air is being compressed into the reservoir and the term "unloaded" refers to a compressor mode where air is not being compressed into the reservoir. The compressor depicted is one which utilizes spring return inlet and discharge valves for each cylinder in which the movement of these valves is caused by the differential pressure across them as opposed to a mechanical coupling to the compressor crank shaft. The subject disclosure may be applicable to machines with either type of valve, but the spring return type will be illustrated here for the sake of brevity. For instance, an unloaded condition or unloaded compressor mode is illustrated in FIG. 3.

The detection component can be a stand-alone component (as depicted), incorporated into the controller component, or a combination thereof. The controller component can be a stand-alone component (as depicted), incorporated into the detection component, or a combination thereof.

FIG. 2 illustrates a detailed view of the compressor set forth in FIG. 1 above. The compressor includes three cylinders 210, 220, 230. Each cylinder contains a piston 218, 228, 238 that is coupled to a crankshaft 250 via connecting rods 240, 242, 244. The crankshaft is driven by the motor to cyclically pull the respective pistons to a Bottom-Dead-Center (BDC) and push the pistons to a Top-Dead-Center (TDC) to output charged air, which is delivered to the reservoir via air lines 280, 282, 284, 286. In this embodiment, the compressor is divided into two stages: a low pressure stage and a high pressure stage to produce charged air in a stepwise approach. The low pressure stage compresses air to a first pressure level which is further compressed by the high pressure stage to a second pressure level. In this example, the low pressure stage includes cylinders 220, 230 and the high pressure stage includes cylinder 210.

In operation, air from the ambient air intake is first drawn into the low pressure cylinders via intake valves 222, 232, which open and close within intake ports 223, 233. The ambient air is drawn in as the low pressure cylinders are pulled towards BDC and the intake valves 222, 232 separate from intake ports 223, 233 to allow air to enter each cylinder 220, 230. Once the pistons reach BDC, the intake valves 222, 232 close the intake ports 223, 233 to contain air within each cylinder. Subsequently, pistons 228, 238 are pushed toward TDC, thereby compressing the ambient air initially drawn into the cylinders. Once the cylinders have compressed the ambient air to a first pressure level, exhaust valves 224, 234 within exhaust ports 225, 235 are opened to release the low pressure air into low pressure lines 280, 282.

The air compressed to a first pressure level is routed to an intermediate stage reservoir 260. The intermediate stage reservoir 260 receives air from one stage of the multistage compressor and provides the compressed air to a subsequent stage of the multistage compressor. In an embodiment, the intermediate stage reservoir 260 is a tank or other volume connected between successive stages by air lines. In other embodiments, the air lines, such as low pressure lines 280, 282 provide sufficient volume to function as an intermediate stage reservoir without the need for a tank or other structure.

In an embodiment, the compressor system also includes an intercooler 264 that removes the heat of compression through a substantially constant pressure cooling process. One or more intercoolers may be provided along with one or more intercooler controllers 262. In some embodiments, the intercooler 264 is integrated with the intermediate stage reservoir 260. A decrease in the temperature of the compressed air increases the air density allowing a greater mass to be drawn into the high pressure stage increasing the efficiency of the compressor. The operation of the intercooler is controlled by the intercooler controller 262 to manage the cooling operation. In an embodiment, the intercooler controller 262 employs a thermostatic control through mechanical means such as via thermal expansion of metal. In a multistage compressor system having more than two stages, an intercooler may be provided at each intermediate stage.

The air at a first pressure level (e.g., low pressure air) is exhausted from the intercooler into low pressure air line 284 and subsequently drawn into the high pressure cylinder 210. More particularly, as piston 218 is pulled toward BDC, the intake valve 212 opens, thereby allowing the low pressure air to be drawn into the cylinder 210 via intake port 213. Once the piston 218 reaches BDC, the intake valve 212 closes to seal the low pressure air within the cylinder 210. The piston is then pushed upward thereby compressing the low pressure air into high pressure air. High pressure air is air at a second pressure level greater than the first pressure level, however, the amount of compression will vary based upon the requirements of the application. As compression increases, the exhaust valve 214 is opened to allow the high pressure air to exhaust into high pressure line 286 via exhaust port 215. An aftercooler 270 cools the high pressure air to facilitate a greater density to be delivered to the reservoir via high pressure air line 288.

The above process is repeated cyclically as the crankshaft 250 rotates to provide high pressure air to the reservoir 180, which is monitored by the reservoir pressure sensor 185. Once the reservoir reaches a particular pressure level (e.g., 140 psi), the compressor operation is discontinued.

In some embodiments, the compressor includes one or more valves configured to vent compressed air from intermediate stages of the compressor system. The unloader valves and/or relief valves may be operated after compressor operations are discontinued, or may be operated during compressor operations to relieve pressure in the compressor system. In an embodiment, an unloader valve 268 is provided in the intermediate stage reservoir 260 and configured to vent the low pressure compressed air from the intermediate stage reservoir, low pressure air lines 280, 282 and intercooler 264. Venting compressed air reduces stress on system components during periods when the compressor is not in use and may extend the life of the system. In another embodiment, the unloader valve 268 operates as a relief valve to limit the buildup of pressure in the intermediate stage reservoir 260. In yet another embodiment, intake valves 222, 232 operate as unloader valves for the cylinders 220, 230 allowing compressed air in the cylinders to vent back to the ambient air intake 114. In another embodiment, the system 200 can include relief valves such as breather valve 174 (also referred to as a crankcase breather valve), a relieve valve on the intercooler 264 (shown in FIG. 3), a relieve valve for air line 286, and/or a rapid unloader valve on the intercooler 264 (shown in FIG. 3).

A compressor, such as the compressor illustrated in FIG. 2, operates to charge the reservoir 180 with compressed air or other gas. Once the compressor charges the reservoir to a determined pressure value the compressor operation is discontinued. In some embodiments, when compressor operations are discontinued, one or more unloader valves are opened to vent intermediate stages of the compressor to the atmosphere. The intake valves of the cylinders as well as unloader valves of the intermediate stage reservoirs may all operate as unloader valves to vent the cylinders of the compressor to the atmosphere. Once the unloader valves are actuated and the cylinders and intermediate stages of the compressor have been vented to the atmosphere the pressure within the reservoir is expected to remain constant as previously discussed.

As discussed above, the controller can be configured to communicate an alert to indicate a potential failure related to the crankcase breather valve based upon a detected change in a rotational speed of the crankshaft of the compressor. In an embodiment, the controller can be configured to schedule a maintenance based upon the detected change in rotational speed and/or the communicated alert in order to perform preventative maintenance.

FIG. 3 illustrates a system 300 that depicts a compressor in an unloaded condition. The system illustrates additional features and/or components that can be included in the embodiments of FIGS. 1 and 2. The system includes a Control Mag Valve (CMV) 302, a Thermostatically Controlled Intercooler System (TCIS) bypass 304, a rapid unloader valve 306, an unloader valve 308 for cylinder 230, an unloader valve 310 for cylinder 220, a relief valve 320, a relief valve 330, and relief valve 340 (e.g., substantially similar to breather valve 174 in FIG. 2 and also referred to as crankcase breather valve).

The crankshaft 250 can include a first end opposite a second end in which the first end is coupled to one or more connecting rods for each respective cylinder. The crankshaft, cylinders, and pistons are illustrated in BDC position based upon the location of the first end. BDC position is a location of the first end at approximately negative ninety degrees (−90 degrees) or 270 degrees. A TDC position is a location of the first end at approximately ninety degrees (90 degrees) or −270 degrees.

Figure 4:
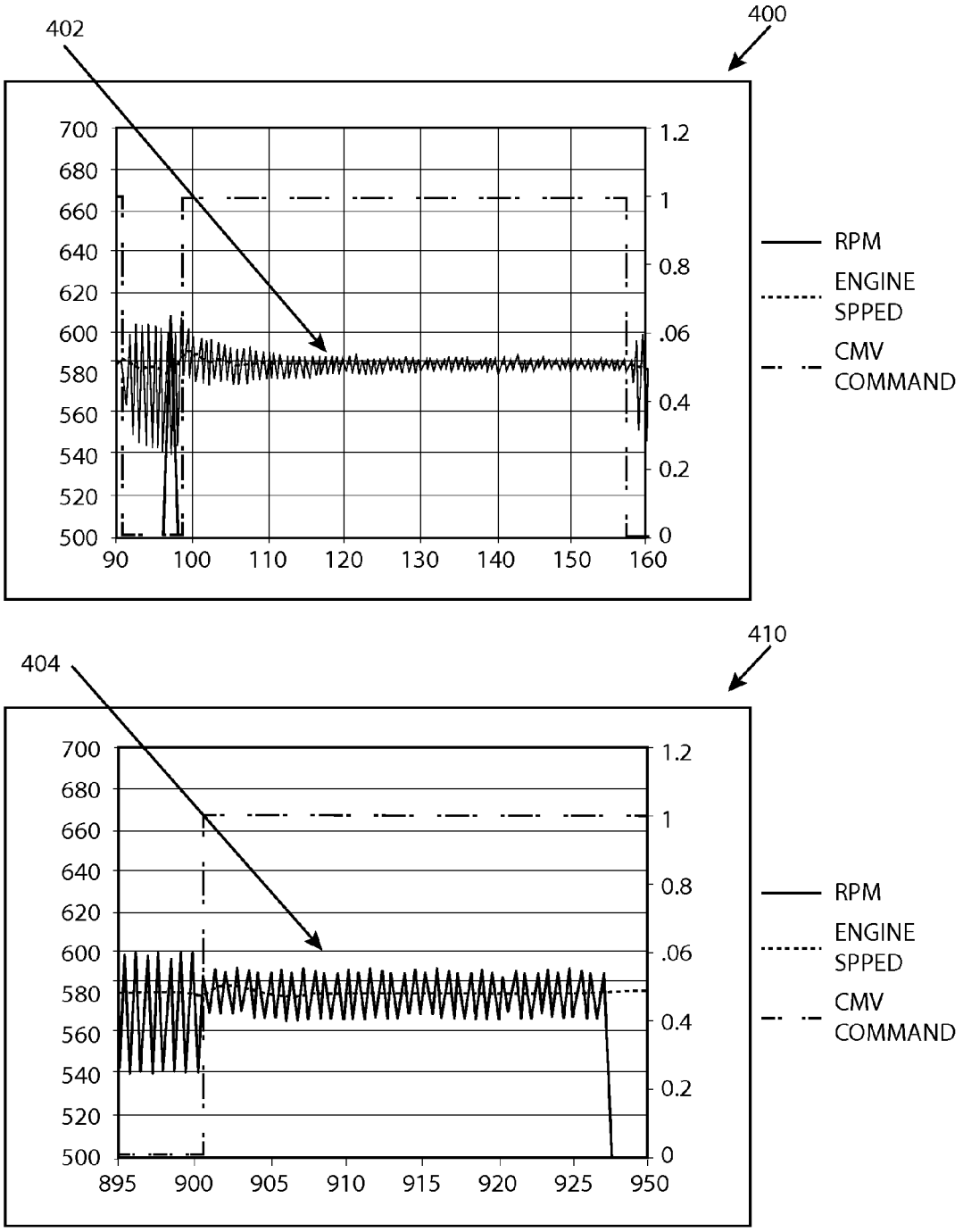
FIG. 4 is an illustration of speed signatures related to detecting a failure for a compressor.

FIG. 4 is an illustration of speed signatures related to detecting a failure for a compressor. Graph 400, illustrates both loaded and unloaded operation for a two stage air compressor which does not include a separate unloader for the inner stage. In this example, the high pressure cylinder intake valve is forced open when in an unloaded state which results in a common pressure in the inner stage volume and the high pressure cylinder. This pressure is typically elevated above ambient but less than main reservoir. This pressure will slowly bleed off through finite leak paths around the rings on the high pressure piston or through weeper holes or other designed-in pressure bleed paths. A speed signature 402 is illustrated that depicts the inter stage air bleed down during unloaded operation. The plot in the 92 to 100 second region is loaded operation while the region after 98 seconds shows the compressor speed after the unloader valves are opened. The decay in the magnitude of speed variation is caused by the reduced air density (and pressure) in the high pressure cylinder. If this pressure did not decay completely, this signature will change to one of a more steady speed variation. This can be an indicator of a leaky discharge valve on the high pressure cylinder. In a graph 410, a speed signature 404 illustrates a non-decaying compressor RPM which confirms that there is no bleed down of the A/C speed signature and thus identifies a leaky discharge valve on the high pressure cylinder. In other words, if a discharge valve is leaking, air will continuously flow back into the cylinder which causes the one per revolution pulse to remain elevated (e.g., less or no decay in the compressor RPM variation) while the reciprocating compressor is running unloaded (discussed in more detail in FIG. 7).

Figure 5:
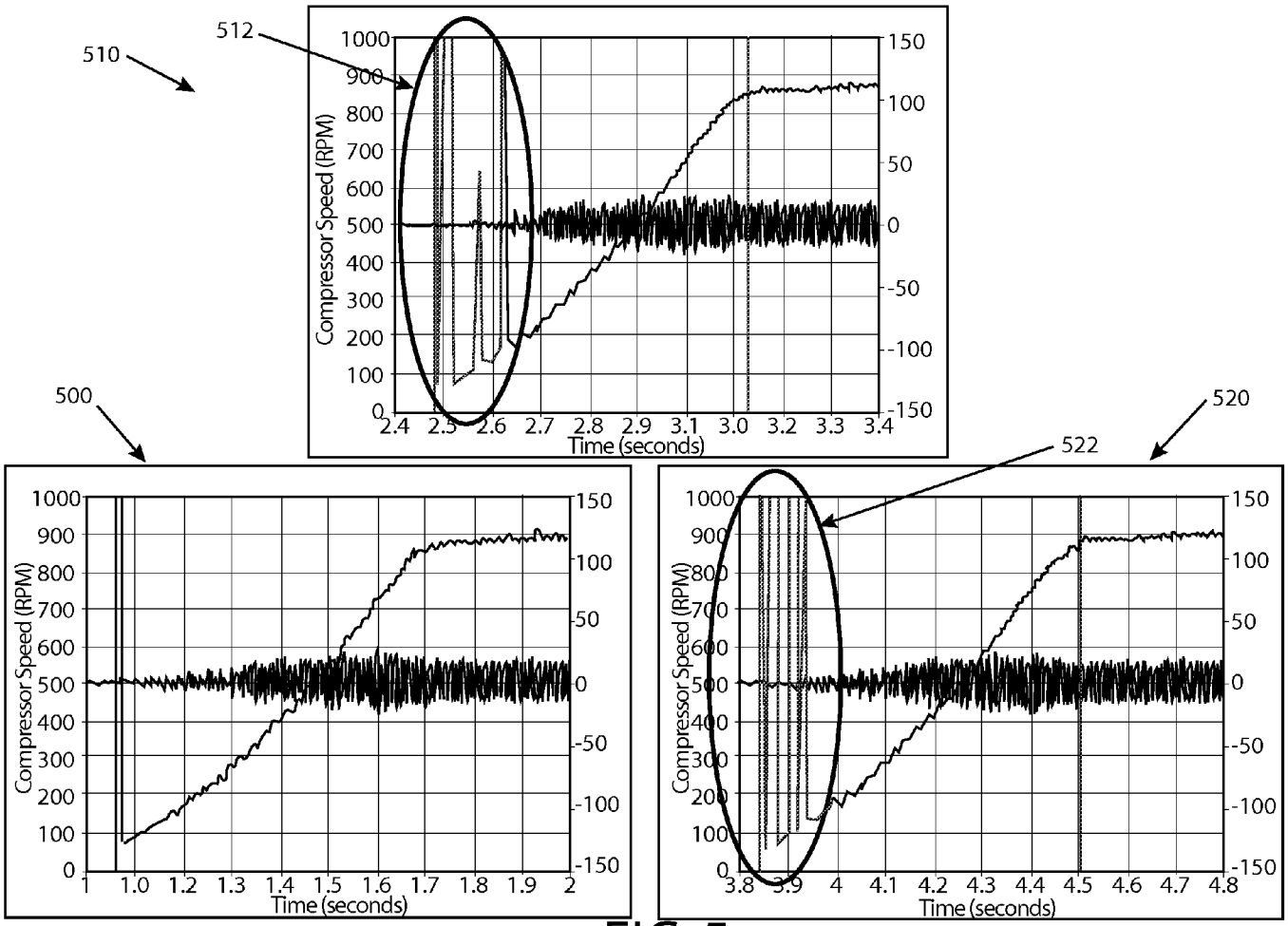
FIG. 5 is an illustration of startup signatures related to detecting a failure for a compressor.

FIG. 5 is an illustration of startup signatures related to detecting a failure for a compressor. Graph 500 illustrates a compressor speed (RPM) over time during a startup of a compressor in which the high pressure discharge valve is healthy (e.g., not deteriorated, not leaking, among others). In graph 510, a compressor speed (RPM) over time during a startup of a compressor in which a cogging signature 512 is illustrated. This cogging signature can be detected which can indicate a failure related to a leaky valve. Moreover, a graph 520 illustrates a compressor speed (RPM) over time during a startup of a compressor is illustrated in which a cogging signature 522 is indicative of a failed valve (discussed in more detail in FIG. 8). In an embodiment, the subject innovation can include the following method that includes at least the steps of: evaluating a speed over a duration of time during a startup of the compressor; identifying a first cogging signature during the duration of time for a high pressure discharge valve; and detecting a second cogging signature that is different than the first cogging signature, wherein the second cogging signature is indicative of a failure of the high pressure discharge valve.

The aforementioned systems, components, (e.g., detection component, controller, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

Figure 6:
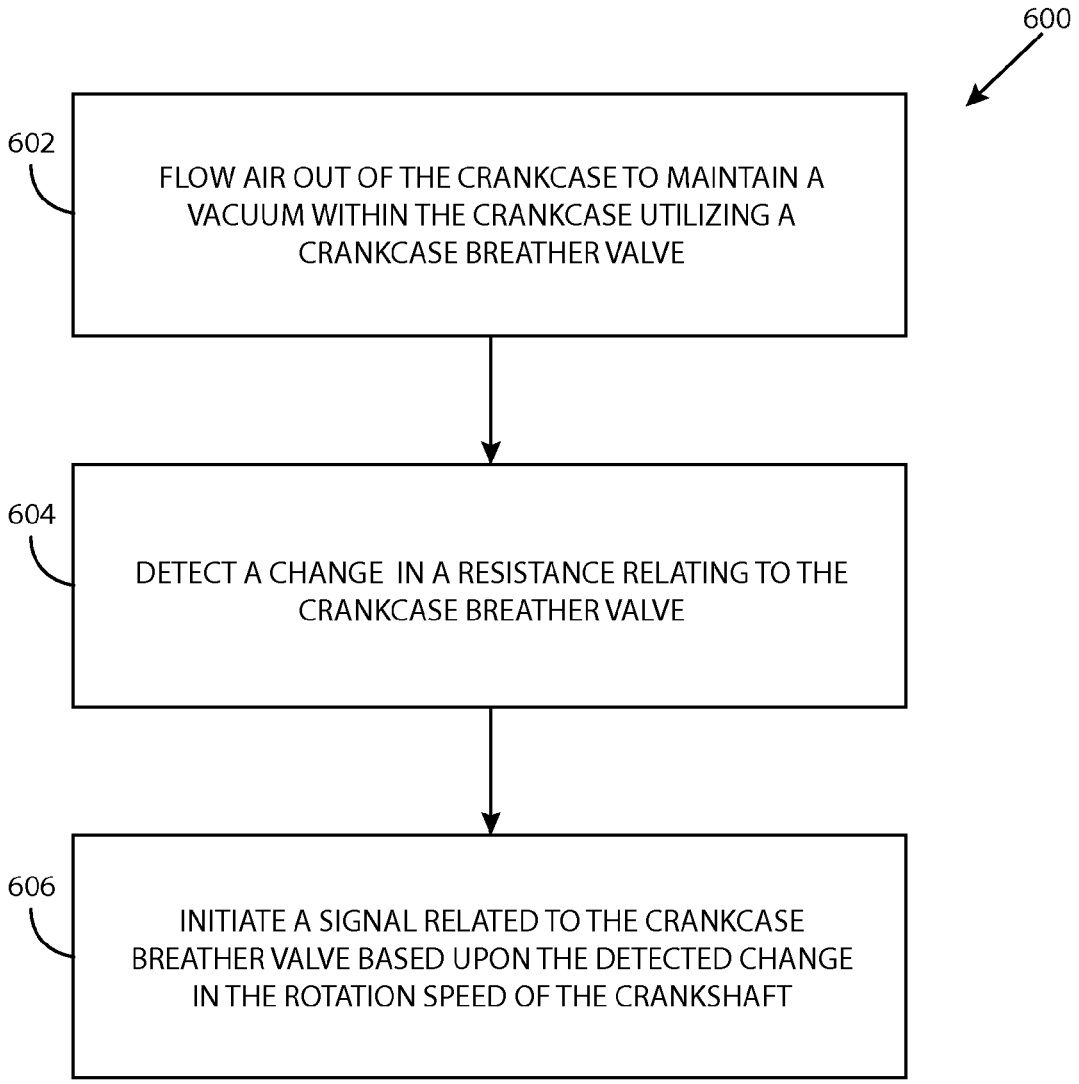
FIG. 6 is an illustration of a flow chart of an embodiment of a method for detecting a deteriorating condition for a compressor based upon a rotational speed of a crankshaft.
Figure 7:
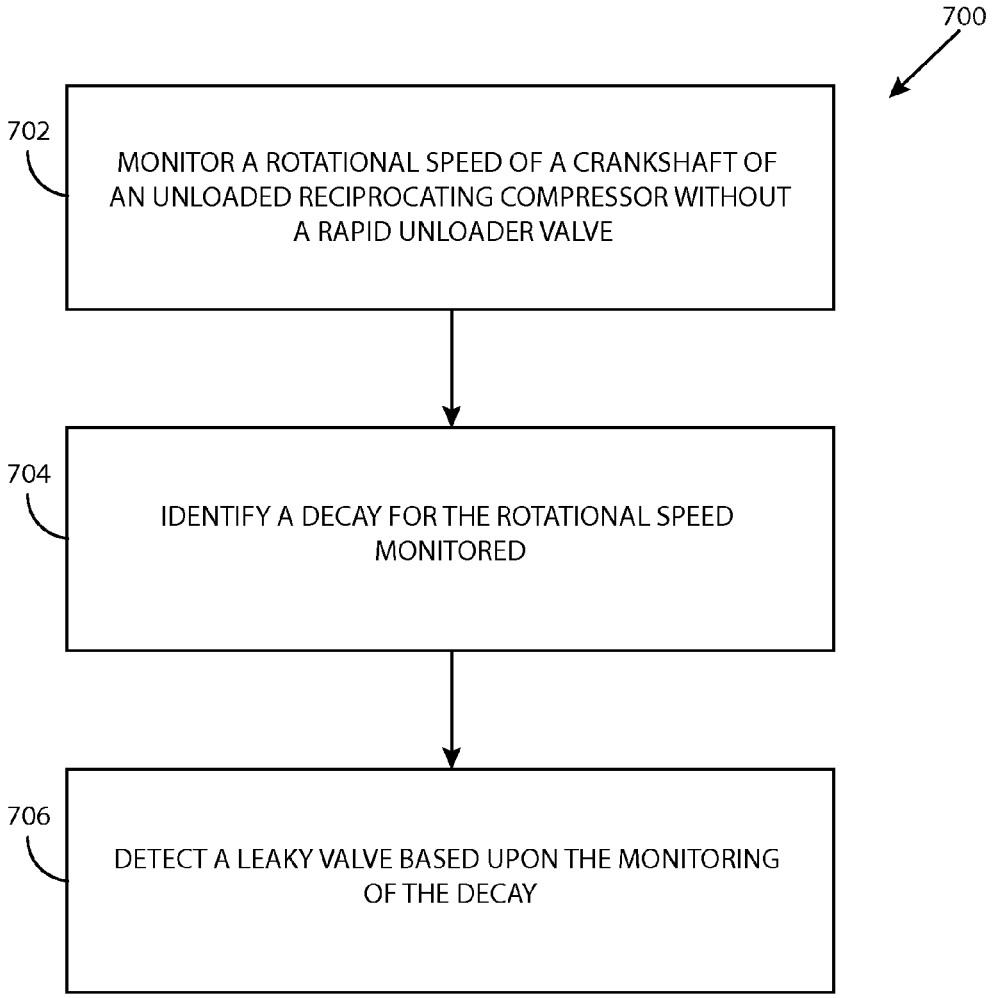
FIG. 7 is an illustration of a flow chart of an embodiment of a method for detecting a failure based upon a speed signature for a compressor.
Figure 8:
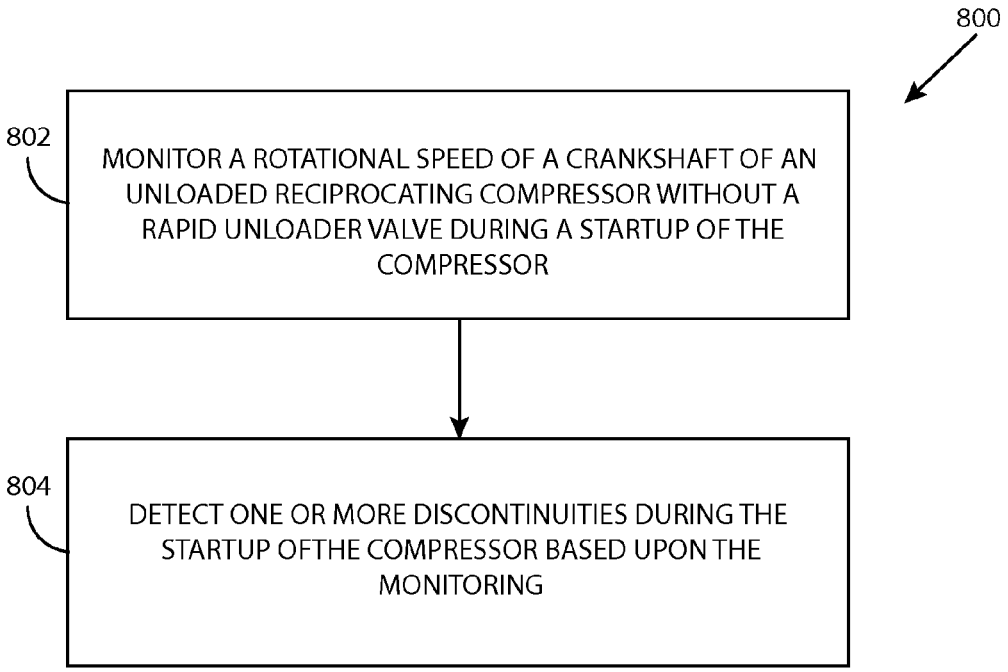
FIG. 8 is an illustration of a flow chart of an embodiment of a method for detecting a failure related to a discharge valve based upon monitoring rotational speed in comparison to a startup signature for the compressor.

In view of the exemplary devices and elements described supra, methodologies that may be implemented in accordance with the disclosed subject matter will be better appreciated with reference to the flow charts of FIGS. 6-8. The methodologies are shown and described as a series of blocks, the claimed subject matter is not limited by the order of the blocks, as some blocks may occur in different orders and/or concurrently with other blocks from what is depicted and described herein. Moreover, not all illustrated blocks may be required to implement the methods described hereinafter. The methodologies can be implemented by a component or a portion of a component that includes at least a processor, a memory, and an instruction stored on the memory for the processor to execute.

FIG. 6 illustrates a flow chart of a method 600 for detecting a deteriorating condition for a compressor based upon a rotational speed of a crankshaft. At reference numeral 602, air can flow out of the crankcase to maintain a vacuum within the crankcase utilizing a crankcase breather valve. At reference numeral 604, a change in a resistance relating to the crankcase breather valve can be detected. In an embodiment, a change can be detected in a rotation speed of the crankshaft due to the resistance related to the crankcase breather valve. At reference numeral 606, a signal related to the crankcase breather valve can be initiated based upon the detected change in the rotation speed of the crankshaft.

In an embodiment of the method, a change can be detected in a rotation speed of the crankshaft due to the resistance related to the crankcase breather valve. In an embodiment of the method, air can be flowed out of the crankcase during a suction stroke of at least one piston of the compressor. In an embodiment, the method can include maintaining vacuum within the crankcase during a compression stroke of at least one piston of the compressor. In an embodiment, the method can monitor a rotational speed of a crankshaft within a crankcase for a compressor driven by a motor. In an embodiment of the method, the rotational speed of the crankshaft can be monitored while the compressor is unloaded. In an embodiment, the method can include monitoring the rotational speed of the crankshaft while the compressor is running at a speed of or below approximately 800 RPM. In an embodiment, the method includes identifying a reduction of the rotational speed of the crankshaft in an AC coupled signature (e.g., variation only). In an embodiment of the method, the reduction is below a one (1) per revolution pulsation in the A/C signature. In an embodiment of the method, an alert can be communicated that indicates a fault, failure, or impending failure associated with the crankcase breather valve. In an embodiment, the method can include monitoring the variation in compressor speed during a coast down stop situation. This method may have certain advantages as it removes the restoration torque provided by the electric motor which my attenuate the variation in compressor speed caused by the defect.

In an embodiment, the method can include scheduling maintenance on the compressor based at least in part on the generated signal and modifying the operating duty cycle of the compressor based at least in part on the generated signal. In an embodiment, the method can include performing maintenance selected from changing oil, changing a strainer, changing the crankcase breather valve, cleaning the crankcase breather valve, inspecting a high pressure head, or changing a high pressure head. In an embodiment, the method can include adjusting a starting torque capability of the compressor drive system based at least in part on the generated signal. In an embodiment, the method can include adjusting an unloaded run time based at least in part on the generated signal.

FIG. 7 illustrates a flow chart of a method 700 for detecting a failure based upon a speed signature for a compressor. At reference numeral 702, a rotational speed of a crankshaft of an unloaded reciprocating compressor without a rapid unloader can be monitored. At reference numeral 704, a decay for the rotational speed monitored can be identified. For instance, a one per revolution pulse in the loaded speed signature will slowly decay when the compressor unloads. The one per revolution pulse in the loaded speed signature will slowly decay as air escapes through a weeper hole (e.g., restricted vent to atmosphere) or past the piston rings when the compressor unloads. If a discharge valve is leaking, air will continuously flow back into the cylinder causing the one per revolution pulse to remain constant while running unloaded—thus identifying a leaking valve. At reference numeral 706, a leaky valve can be detected based upon the monitoring of the decay. For instance, if a decay is not detected, a leaky valve is identified.

FIG. 8 illustrates a flow chart of a method 800 for detecting a failure related to a discharge valve based upon monitoring rotational speed in comparison to a startup signature for the compressor. At reference numeral 802, a rotational speed of a crankshaft of an unloaded reciprocating compressor without a rapid unloader can be monitored during a startup of the compressor. For instance, a tooth-pulse speed sensor can be utilized to monitor a startup of the compressor. At reference numeral 804, one or more discontinuities (e.g., cogging signature(s)) can be detected during the startup of the compressor based upon the monitoring. For instance, a discontinuity can be a "cogging" as detected by a, for instance, tooth-pulse speed sensor. A leaking discharge valve can cause the compressor to start harder due to compressed air trapped in the cylinder.

In an embodiment of the system, the compressor is a reciprocating compressor. In an embodiment of the system, the crankcase breather valve is configured to maintain at least a partial vacuum within the crankcase during a compression stroke of at least one piston of the compressor. In an embodiment of the system, the crankcase breather valve is configured to allow a flow of air out of the crankcase during a suction stroke of at least one piston of the compressor. In an embodiment of the system, the controller is configured to determine a reduction in the rotational speed of the crankshaft, where the reduction is below a one (1) per revolution pulsation in an A/C (e.g., speed with average value removed) signature. In an embodiment of the system, the controller is configured to respond to a detected reduction in the rotational speed by generating a signal indicative of identified a fault, a failure, or an impending failure associated with the crankcase breather valve. In an embodiment of the system, the controller is configured to monitor the rotational speed of the crankshaft while the compressor is at least one of unloaded or running at a speed at or below approximately 800 RPM.

In an embodiment, a compressor includes a crankcase, a crankshaft, and a crankcase breather valve. The crankcase breather valve is configured to allow air to flow out of the crankcase during a suction stroke of the compressor, and to maintain an at least partial vacuum (e.g., air does not flow out) during a compressor stroke of the compressor. The vacuum confers a resistance upon the crankshaft, which results in a once-per-revolution pulsation in the A/C speed signature of the crankshaft. If there is something wrong with the crankcase breather valve (e.g., leaky, stuck open), however, the A/C speed signature will deviate from the one-per-revolution pulsation. In embodiments, systems and methods involve detecting such a deviation, and generating a signal responsive to detecting the deviation, wherein the signal can be used for diagnostics, repair, notifications, and the like.

In an embodiment, detecting the change in the resistance to piston motion comprises detecting a change in a rotation speed of the crankcase. In an embodiment, the step of flowing the air out of the crankcase comprises flowing the air out of the crankcase during a suction stroke. In an embodiment, the method can include: flowing the air out of the crankcase during a suction stroke of at least one piston of the compressor; and maintaining vacuum within the crankcase during a compression stroke of the at least one piston of the compressor; wherein variations in the vacuum that is maintained during the compression stroke result in the change in the resistance to piston motion. In an embodiment, detecting the change in the resistance to piston motion comprises at least one of the following: monitoring a rotational speed of a crankshaft within the crankcase; or monitoring the rotational speed of the crankshaft while the compressor is unloaded. In an embodiment, the method can include: evaluating a speed over a duration of time during a startup of the compressor; identifying a first cogging signature during the duration of time for a high pressure discharge valve; and identifying a second cogging signature that is different than the first cogging signature, wherein the second cogging signature is indicative of a failure of the high pressure discharge valve.

In an embodiment, the method can include monitoring a rotational speed of the crankshaft while the compressor is running at a speed at or below approximately 800 revolutions per minute to detect the change in the resistance. In an embodiment, the method can include identifying a reduction of a variation signature in the detected change in the resistance. In an embodiment, the reduction is below a one per revolution pulsation in the variation signature. In an embodiment, initiating the signal comprises communicating an alert that indicates at least one of a fault, a failure, or an impending failure associated with the crankcase breather valve. In an embodiment, the method can include: scheduling maintenance on the compressor based at least in part on the signal; and modifying an operating duty cycle of the compressor based at least in part on the signal.

In an embodiment, the method can include performing the maintenance selected from changing oil, changing a strainer, changing the crankcase breather valve, cleaning the crankcase breather valve, inspecting a high pressure head, or changing the high pressure head. In an embodiment, the method can include adjusting a starting torque capability of the compressor based at least in part on the signal. In an embodiment, the method can include adjusting an unloaded run time of the compressor based at least in part on the signal. In an embodiment, the compressor is a reciprocating compressor. In an embodiment, the crankcase breather valve is configured to maintain at least a partial vacuum within the crankcase during a compression stroke of at least one piston of the compressor. In an embodiment, the crankcase breather valve is configured to allow a flow of air out of the crankcase during a suction stroke of at least one piston of the compressor.

In an embodiment, the controller is configured to determine a reduction in the rotational speed of the crankshaft, the reduction is below a one per revolution pulsation in an A/C signature, wherein the controller is configured to determine the change in resistance based on a determined reduction in the rotational speed of the crankshaft. In an embodiment, the controller is configured to respond to a detected reduction in the rotational speed by generating a signal indicative of at least one of a fault, a failure, or an impending failure associated with the crankcase breather valve. In an embodiment, the controller is configured to monitor the rotational speed of the crankshaft while the compressor is at least one of unloaded or running at a speed at or below approximately 800 revolutions per minute.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the invention, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A system, comprising:

a detector that is configured to detect a rotational speed of a crankshaft included in a compressor that provides compressed air and that includes a crankcase breather valve coupled with the crankshaft; and a controller having a processor and a memory, wherein the controller is in communication with the detector and configured to determine a change in resistance relating to the crankcase breather valve based at least in part on the rotational speed of the crankshaft that is detected, the controller configured to generate a signal indicative of the change in the rotational speed of the crankshaft, wherein the signal is indicative of at least one of a fault, a failure, or an impending failure associated with the crankcase breather valve; and wherein the controller is configured to adjust at least one of a duty cycle of the compressor, a starting torque capability of the compressor, or an unloaded run time of the compressor based at least in part on the signal.

2. The system of claim 1, wherein the compressor is a reciprocating compressor.

3. The system of claim 1, wherein the controller is configured to determine a reduction in the rotational speed of the crankshaft, the reduction is below a one per revolution pulsation in an A/C signature, wherein the controller is configured to determine the change in resistance based on the determined reduction in the rotational speed of the crankshaft.

4. The system of claim 3, wherein the controller is configured to monitor the rotational speed of the crankshaft while the compressor is at least one of unloaded or running at a speed at or below approximately 800 revolutions per minute.

5. The system of claim 1, wherein the compressor includes a crankcase in which the crankshaft is disposed, and wherein the crankcase breather valve is configured to maintain at least a partial vacuum within the crankcase during a compression stroke of at least one piston of the compressor.

6. The system of claim 1, wherein the compressor includes a crankcase in which the crankshaft is disposed, and wherein the crankcase breather valve is configured to allow a flow of air out of the crankcase during a suction stroke of at least one piston of the compressor.

7. The system of claim 1. wherein the controller is configured to schedule maintenance on the compressor based at least in part on the signal, the maintenance selected from changing oil, changing a strainer, changing the crankcase breather valve, cleaning the crankcase breather valve, inspecting a high pressure head, or changing the high pressure head.

8. The system of claim 1, wherein the compressor is onboard a vehicle.

9. The system of claim 1, wherein the controller is configured to adjust all three of the duty cycle of the compressor, the starting torque capability of the compressor, and the unloaded run time of the compressor based at least in part on the signal.

10. The system of claim 9, wherein the compressor is a reciprocating compressor.

11. A system, comprising:

a detector that is configured to detect a rotational speed of a crankshaft included in a compressor that provides compressed air and that includes a crankcase breather valve coupled with the crankshaft; and a controller having a processor and a memory, wherein the controller is in communication with the detector and configured to determine a change in resistance relating to the crankcase breather valve based at least in part on the rotational speed of the crankshaft that is detected, wherein the controller is configured to determine a reduction in the rotational speed of the crankshaft, the reduction is below a one per revolution pulsation in an A/C signature, wherein the controller is configured to determine the change in resistance based on the determined reduction in the rotational speed of the crankshaft, wherein the controller is configured to respond to the detected reduction in the rotational speed by generating a signal indicative of at least one of a fault, a failure, or an impending failure associated with the crankcase breather valve;

wherein the controller is configured to adjust at least one of a duty cycle of the compressor, a starting torque capability of the compressor, or an unloaded run time of the compressor based at least in part on the signal.

12. The system of claim 11, wherein the controller is configured to monitor the rotational speed of the crankshaft while the compressor is at least one of unloaded or running at a speed at or below approximately 800 revolutions per minute.

13. The system of claim 11, wherein the compressor is a reciprocating compressor.

14. The system of claim 11, wherein the compressor includes a crankcase in which the crankshaft is disposed, and wherein the crankcase breather valve is configured to maintain at least a partial vacuum within the crankcase during a compression stroke of at least one piston of the compressor.

15. The system of claim 11, wherein the compressor includes a crankcase in which the crankshaft is disposed, and wherein the crankcase breather valve is configured to allow a flow of air out of the crankcase during a suction stroke of at least one piston of the compressor.

16. The system of claim 11, wherein the controller is configured to schedule maintenance on the compressor based at least in part on the signal, the maintenance selected from changing oil, changing a strainer, changing the crankcase breather valve, cleaning the crankcase breather valve, inspecting a high pressure head, or changing the high pressure head.

17. The system of claim 11, wherein the compressor is onboard a vehicle.

18. The system of claim 11, wherein the controller is configured to adjust all three of the duty cycle of the compressor, the starting torque capability of the compressor, and the unloaded run time of the compressor based at least in part on the signal.

19. The system of claim 18, wherein the compressor is a reciprocating compressor.

* * * * *